US005435161A

United States Patent [19]

King

[11] Patent Number: 5,435,161

[45] Date of Patent: Jul. 25, 1995

[54] EXTRUSION METHOD UTILIZING VARIABLE BILLET PREHEAT TEMPERATURE

[75] Inventor: David A. King, Chandler, Ariz.

[73] Assignee: Aluminum Company of America, Pittsburgh, Pa.

[21] Appl. No.: 141,823

[22] Filed: Oct. 22, 1993

[51] Int. Cl.[6] ..... B21C 31/00

[52] U.S. Cl. ..... 72/13; 72/271

[58] Field of Search ..... 72/13, 270, 271, 20, 72/253.1, 272, 342.7

[56] References Cited

U.S. PATENT DOCUMENTS

| | | | |
|---|---|---|---|
| 2,249,353 | 7/1941 | Fritzlen . | |
| 2,863,557 | 12/1958 | Münker . | |
| 3,670,542 | 6/1972 | Kemppinen et al. . | |
| 3,798,942 | 3/1974 | Bräckow . | |
| 4,056,963 | 11/1977 | McDonald et al. . | |
| 4,066,480 | 1/1978 | Gullotti et al. . | |
| 4,675,826 | 6/1987 | Gentry et al. . | |
| 4,843,576 | 6/1989 | Smith et al. . | |
| 5,167,138 | 12/1992 | Sinha et al. . | |
| 5,325,694 | 7/1994 | Jenista | 72/270 |

FOREIGN PATENT DOCUMENTS

| | | | |
|---|---|---|---|
| 3404054 | 8/1985 | Germany | 72/271 |
| 32518 | 2/1983 | Japan | 72/271 |
| 138018 | 6/1991 | Japan | 72/253.1 |
| 89128 | 3/1992 | Japan | 72/271 |
| 104132 | 4/1993 | Japan | 72/271 |

*Primary Examiner*—Lowell A. Larson
*Attorney, Agent, or Firm*—David W. Pearce-Smith

[57] ABSTRACT

A method of extruding a plurality of billets. The method includes (a) preheating a billet to a preheat temperature; (b) extruding the billet so that the exit temperature of the extrusion is within a predetermined temperature range; (c) measuring the extrusion pressure during (b); (d) comparing the measured extrusion pressure to a reference pressure range; (e) if the extrusion pressure was below said reference pressure range, resetting the preheat temperature so that it is lowered by a predetermined increment; (f) if the extrusion pressure climbed above the reference pressure range, resetting the preheat temperature so that it is raised by a predetermined increment; (g) preheating another billet to the preheat temperature; and (h) repeating (b)-(g) until all the billets have been extruded. In a preferred embodiment, the billet is formed form an aluminum alloy.

28 Claims, 4 Drawing Sheets

EXTRUSION METHOD UTILIZING VARIABLE BILLET PREHEAT TEMPERATURE

TECHNICAL FIELD

This invention relates to methods of working materials such as metals. More particularly, the invention relates to methods of extruding hard aluminum alloys.

BACKGROUND ART

The metal working process known as extrusion involves pressing metal stock (ingot or billet) through a die opening having a predetermined configuration in order to form a shape having indefinite length and a substantially constant cross section. In the extrusion of aluminum alloys with which this invention is particularly concerned, the aluminum stock is preheated to the proper extrusion temperature. It is then placed into a heated cylinder. The cylinder utilized in the extrusion process has a suitable die at one end which has art opening of the desired shape and a reciprocal piston or ram having approximately the same cross-sectional dimensions as the bore of the cylinder. This piston or ram moves against the stock to compress the stock. The opening in the die is the path of least resistance for the billet under pressure, and metal deforms and flows through the die opening to produce a continuous extruded product having the same cross-sectional shape as the die opening.

The extrusion process generates a considerable amount of heat, and as a result, the temperature of the extruded product may vary during the extrusion process. Heat can be a desirable by-product in that the hotter the metal the more deformable the metal becomes. Initially, the die and surrounding parts of the extrusion press act as a heat sink. As the process proceeds, the temperature gap is reduced between the die, and the billet and the die and extrusion press stop acting as a heat sink. Then, the temperatures of the billet and the die both begin to rise. In addition, if the extrusion speed is high, heat may not be dissipated fast enough, and the temperature of the billet rises.

When extruding a series of billets, the temperature of the extrusion product can vary from different billets. In some instances, the rise in temperature may be sufficient to melt or at least weaken the metal to the point at which the frictional stresses at the surface cause cracking. Therefore, after the billet has reached a maximum temperature, the heat begins to become an undesirable by-product of the extrusion process from the standpoint of producing commercial quality extruded product.

The present invention is particularly concerned with hard aluminum base alloys. Extruded profiles of hard aluminum alloys have considerable commercial value. Such alloys find diversified use as structural materials and are used in the aeronautics industry because of their very high strength-to-weight properties. In order to produce extruded articles from such alloys in the most economical manner, the extrusion process should be carried out at the highest extrusion speed possible for the extrusion press being used.

Extrusion pressures, speed and temperature are factors that affect the quality of hard alloy,s as extruded products. Extrusion speed is usually referred to in terms of the progression of extruded material exiting from the die in linear feet per unit of time (minute or hour) or in terms of the progression of the ram (ram speed) pushing against the metal stock. In order to achieve acceptable surface quality in extruded hard aluminum alloy products, a certain limited range of extrusion speeds and temperatures must be closely observed, with the range being related to the size and complexity of the extrusion, the composition of the alloy and the reduction in cross-sectional area of the metal stock during the extrusion process.

Exceeding the predetermined speed and temperature ranges generally causes a rupture of the extrusion surface and also other defects such as recrystallization, blistering and broken surface, which result in rejection of the extruded product. High strength aluminum alloys must be extruded more slowly and at lower temperatures than lower strength aluminum alloys in order to avoid surface cracking of the high strength alloys with the resulting decrease in productivity. In addition to surface quality, the temperature of the billet must be kept above a certain minimum temperature to avoid phase changes in the crystal structure of the extrusion product which could greatly change the strength characteristics of the final extruded product.

Furthermore, a typical extrusion plant often has thousands of different dies that produce thousands of different shapes. The same alloy behaves differently for each of the thousands of dies and requires different preheat temperatures and extrusion rates depending on the die ratio, die layout and billet lengths. In the art, the extrusion dies are typically classified into groups depending on features, such as complexity, wall thickness and shape, to try to predict how to best extruded an alloy.

The extrusion conditions (speed and temperature) of hard aluminum alloys are determined empirically and kept below safe speed and temperature limits by experience to reduce the risk of impairing the quality of the extruded product. If these safe limits are set too low, the productivity and thus the profitability of an extrusion plant may be unnecessarily placed in jeopardy. In addition, when operating within the empirically determined safe limits, often there is considerable variation within an extruded piece and from piece to piece for the same shape.

Thus, it can be seen that it would be of great advantage, particularly in high strength aluminum alloys, if the properties of an extruded product and the productivity of an extrusion press can be improved together.

It was against this background that the development of the present invention came about.

The primary object of the present invention is to improve the productivity of an extrusion press.

Another object of the present invention is to improve the productivity of an extrusion press without significantly decreasing the commercial quality of the product that is being extruded. The commercial quality of the extruded product is evaluated in terms of tensile and field strengths and grain structure.

Yet another object of the present invention is to provide a method and system for extruding high strength aluminum alloys at the highest possible extrusion speeds without loss of extruded product due to physical defects.

Another object of the present invention is to remove the guesswork out of predicting safe extrusion speeds and thus close the gap between the ideal safe speed and the actual operating speed of the extrusion press.

Still another objective of the present invention is to provide a method and apparatus that is capable of increasing productivity in extruding high strength aluminum alloys for a wide variety of shapes and sizes.

These and other objects and advantages of the present invention will be more fully understood and appreciated with reference to the following description.

SUMMARY OF THE INVENTION

In accordance with the present invention, there is disclosed a method of extruding a plurality of billets which includes: (a) preheating a billet to a preheat temperature; (b) extruding the billet so that the exit temperature of the extrusion is within a predetermined temperature range; (c) measuring the extrusion pressure during (b); (d) comparing the measured extrusion pressure to a reference pressure range; (e) if the extrusion pressure is below said reference pressure range, resetting the preheat temperature so that it is lowered by a predetermined increment; (f) if the extrusion pressure is above the reference pressure range, resetting the preheat temperature by a predetermined increment; (g) preheating another billet to the preheat temperature; and (h) repeating (b)–(g) until all the billets have been extruded. In a preferred embodiment, the billet is a hard aluminum alloy.

A second embodiment of the invention is a method of extruding comprising: (a) providing an extrusion die with an integral heating unit; (b) activating said heating unit to heat an extrusion die; (c) heating a billet formed from a hard aluminum alloy to a metal preheat temperature; (d) extruding said heated billet through said extrusion die; (e) measuring the temperature of said extrusion as it exits said die; and (f) controlling the extrusion parameters so that the exit temperature is maintained within a predetermined temperature range.

A third embodiment of the invention is a method of extruding comprising: (a) providing an extrusion die with integral heating and cooling units; (b) activating said heating unit to heat an extrusion die; (c) heating a billet formed from a hard aluminum alloy to a metal preheat temperature; (d) extruding said heated billet through said extrusion die; (e) measuring the temperature of said extrusion as it exits said die; and (f) controlling the exit temperature of the extrusion by activating and deactivating the heating and cooling units so that the exit temperature is maintained within a predetermined temperature range.

BRIEF DESCRIPTION OF THE DRAWINGS

Other features of the present invention will be further described or rendered obvious in the following related description of the preferred embodiment that is to be considered together with the accompanying drawings wherein like figures refer to like parts and further wherein.

DEFINITIONS

Figure 1:
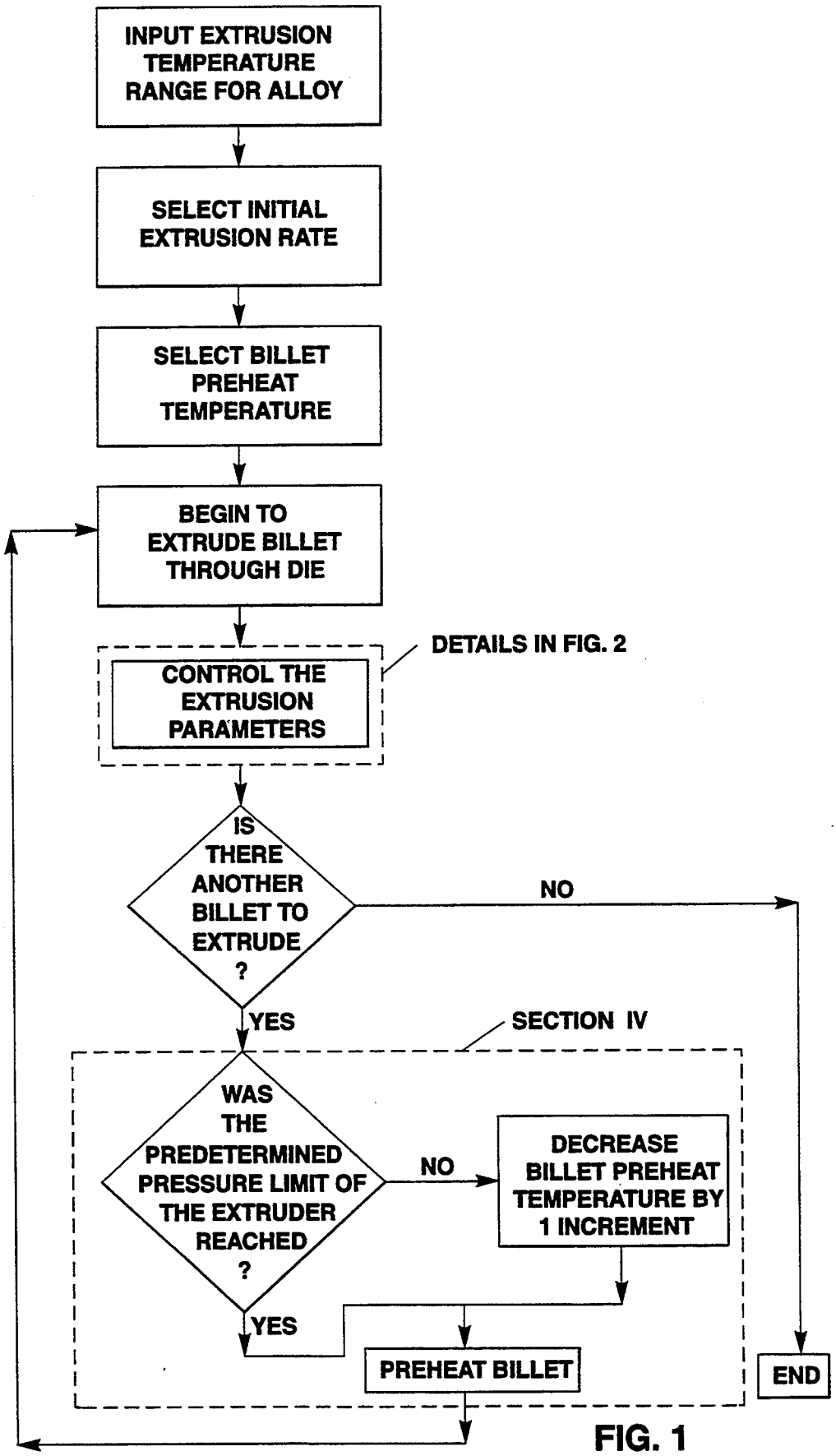
FIG. 1 is a logic and process flow diagram showing the decisions of the process for controlling the extrusion parameters for a series of billets. Decisions in a feedback loop change the billet preheat temperature from a previous preheat temperature based on the extrusion pressure used in extruding the previous billets.

The terms "tearing ", "broken surface ", "surface checking" and "chatter cracks" are interchangeable terms used in the art to refer to surface defects that form a pattern of fine transverse cracks resulting from longitudinal tensile stresses that are high compared with the strength of the alloy at its working temperature. Tearing is a limiting factor for extrusion of hard aluminum alloys and is caused when the predetermined speed and temperature range for an alloy are exceeded. The cracks are unacceptable for commercial product from the standpoints of surface appearance, finishing ability, dimensional accuracy and mechanical integrity of the extruded product.

The term "bar" is used herein to refer to metal that has been formed into a solid product that is long in relation to its cross section, which is square, rectangular, a regular hexagon, or octagon, and whose perpendicular distance between parallel faces is 0.375 inches or greater.

The term "foil" is used herein to refer to metal that has been formed into a layer having a thickness of less than about 0.15 mm (0.006 inch). Foil is commonly a rolled product having a rectangular cross section.

The terms "hard alloy" and "high strength aluminum alloys" are used interchangeably here, in to refer to aluminum alloys that contain alloying elements which following a solution heat treatment provide high strength suitable for aircraft applications. In addition, hard alloys require a solution heat treatment after working to develop their properties. Examples of hard alloys include 2000 series, 5000 series and 7000 series alloys of the Aluminum Association classification system. These alloy series are also referred to in the art as 2XXX, 5XXX and 7XXX alloys.

The term "homogenize" is used herein to refer to a high temperature soaking treatment where a substantial portion of the soluble constituents of the alloy have been dissolved. This operation causes undissolved particles of the soluble elements located at the grain boundary and in the eutectic network to go into solid solution. It is usually accompanied by a virtual disappearance of an as-cast cored dendritic structure.

The term "plate" is used herein to refer to metal that has been formed into a layer having a thickness greater than about 6.325 mm (0.249 inches). Plate is commonly a rolled product having a rectangular cross section.

The term "rod" is used herein to refer to metal that has been formed into a solid product that is long in relation to its cross-sectional dimensions and has a cross section other than that of sheet, plate, bar, tube or wire.

The term "sheet" is used herein to refer to metal that has been formed into a layer having a thickness greater than about 0.15 mm (0.006 inch) and less than about 6.325 mm (0.249 inch). Sheet is commonly a rolled product having a rectangular cross section.

The term "wire" is used herein to refer to metal that has been formed into a solid product that is long in relation to its cross section. The cross section is square or rectangular with sharp or rounded comers or edges, or is round, a regular hexagon, or regular octagon, and whose diameter or greatest perpendicular distance between parallel faces is less than 9.525 mm (0.375 inch).

MODE FOR CARRYING OUT THE INVENTION

The hard aluminum alloys have been found difficult to hot work in commercial production. Extrusion conditions (speed and temperature) of hard aluminum alloys are kept below a safe limit by experience to reduce the risk of sacrificing the desired properties, and as a result, productivity and profitability of an extrusion press are less than optimal.

Typically, the preheat temperature is changed only if unacceptable extruded product is produced. Often the cracks associated with tearing may be no deeper than 0.001 to 0.005 inch and cannot be detected until after the extruded product has been anodized. Since the cracks grow larger as the extrusion speed is increased and disappear as the extrusion speed is decreased, the extrusion process is frequently performed well below an empirically determined maximum extrusion speed to insure that only commercially acceptable product is produced.

The present invention is a method and apparatus for increasing the productivity and profitability of an extrusion press without sacrificing the commercial quality of the product. As will be described in greater detail below, the present invention includes: (1) monitoring the exit temperature of the extruded product as it exits the die, (2) controlling heating and/or cooling units, and (3) decreasing the billet preheat temperature for subsequent billets until the capacity of the extrusion press is being fully utilized. Surprisingly, the method of the present invention has been found to increase the uniformity of extruded product and thus increase the quality of the product while simultaneously increasing the productivity of the extrusion press.

The stock normally used for the production of extruded aluminum base alloy articles is in the form of ingots or cast billets. The ingots may be produced by any of the well known casting processes in the art, the continuous or semi-continuous method being the most commonly used at present. Because the ingot is cast, there is a certain amount of inhomogeneity in the structure, and the ingot is homogenized. The homogenization treatment is at a temperature of from 842° to 1050° F. (450° to 565.5° C.), preferably from 842° to 950° F. (450° to 510° C.), for from 10 to 24 hours, preferably at least 15 hours. The process of the present invention is particularly appropriate for alloys such as AA 7178 which have deliberate additions of elements with limited solubility so that the homogenization treatment of the present invention drives these additions out of the solution.

Following the homogenization step, the alloys are cooled to room temperature at any desired rate. This cooling to room temperature is preferably air cooling. The alloys may be optionally cooled following homogenization to at least 800° F. (426.7° C.) at a rate of less than 100° F. (37.8° C.) per hour, preferably at a rate of less than 70° F. (21.1° C.) per hour. This optional slow cooling is followed by cooling of the alloys to room temperature at any desired rate. This cooling to room temperature is also preferably air cooling.

After cooling the homogenized alloy to substantially room temperature, the material is reheated in a furnace to an elevated temperature called the preheat temperature. Those skilled in the art will acknowledge that the preheat temperature is generally the same for each billet that is to be extruded in a series of billets and is based on experience.

The preheat temperature represents the best guess starting point for extruding the billet into the desired configuration without producing commercially unacceptable product. The selection of a preheat temperature can have a major impact on the productivity and thus the profitability an extrusion press. Preheating the billet to too low a temperature results in slower extrusion rates and less metal being extruded per unit time. Preheating the billet to too high a temperature results in tearing and the production of unacceptable product. Typically, the preheat temperature is set lower than necessary to insure that only commercially acceptable product is extruded.

After the material has soaked at the preheat temperature, it is ready to be placed in the extrusion press and extruded. In an effort to avoid unnecessary cooling of the billet, care is taken to minimize the time it takes to transport the material from the preheat furnace to the extrusion press. The billet is placed into a preheated compartment or container in the extrusion press. All of the foregoing steps relate to practices that are well known to those skilled in the art of casting and extruding. Each of the foregoing steps is related to metallurgical control of the metal to be extruded.

Turning first to FIG. 1, there is illustrated a logic and process flow diagram showing the decisions of the process of the present invention for controlling the extrusion parameters for a series of billets. The process begins by first selecting a desired temperature range for the alloy, an extrusion rate and a billet preheat temperature.

Conventional extrusion process is then begun and the preheated billet is forced through a die by a ram hydraulically driven by a main cylinder by pumps that are operative in response to a pump control to vary their output. In this manner, the main cylinder forces the ram either directly against the billet or indirectly against a dummy block which in turn causes the billet to pass through a die and a platen and onto a runout table. As will be discussed in greater detail below, a device is used to monitor the extrusion speed and the exit temperature of the product and control the process in a manner similar to that shown in FIGS. 2 and 3 to insure that good commercial product is produced.

The criticality of the temperature control during extrusion is necessitated by the temperature sensitivity of the hard aluminum alloys involved. Temperature control is a function of the interrelationship between heat generated by the working process itself and heat conducted away by the extrusion tools and surroundings. The heat generated by the process is a function of the speed of extrusion, the individual extruded shape, the extrusion ratio and the alloy involved and, therefore, cannot be rigidly defined herein.

Surprisingly, I have found that by (1) monitoring the exit temperature of the extruded product as it exits the die, (2) controlling heating and/or cooling units that cool and heat in the vicinity of the die, and (3) decreasing the billet preheat temperature for subsequent billets, it is possible to safely increase the speed of extrusion (ram speed) and hence the productivity of the extrusion press without jeopardizing the commercial quality of the extruded product.

The monitoring of the exit temperature of the extruded product is performed by first measuring the temperature in the vicinity of the die and then comparing the measured temperature to preselected upper and lower (maximum and minimum) temperature limits for the alloy. The temperature is measured using known devices such as thermocouples or optical pyrometers. The equipment that is used to measure exit temperature is not considered to be critical to practicing the present invention.

It is not critical that the temperature measuring device that is used display the true temperature of the material as it exits the die; it need only be consistent. Therefore, it is important that conditions used in establishing the upper temperature limit for a given alloy are kept constant when measuring the temperature of the extruded product. When using an optical pyrometer, care must be taken to avoid inaccurate temperature readings from vibrations, smoke, stray reflections, changes in ambient lighting and the like.

The maximum and minimum temperature limits vary from alloy to alloy and are related to the chemical composition of the alloy. The maximum and minimum temperatures do not change based on the shaped of the die; and therefor, once they are empirically determined for an alloy, they need not be determined again, provided of course that conditions used in establishing the upper temperature limit for a given alloy are kept constant.

The measured exit temperature need not be the exact actual temperature of extruded product as it leaves the die. The measured temperature need only result in the production of commercially acceptable extruded product.

The upper temperature limit is based on observations of the maximum exit temperature measured before tearing occurs. Since tearing is not always readily detected until after the product has been anodized, it is important that the calibration of the temperature monitoring device be maintained after a maximum exit temperature limit for a given alloy has been determined.

The lower temperature limit is based on observations of the development of poor properties in the extruded product when the exit temperature is too low. The exact lower temperature limit will vary from alloy to alloy, but a lower temperature limit set at 100° F. below the maximum temperature has been found to be useful.

The heating and/or cooling units, which cool and heat in the vicinity of the die, are activated and deactivated in response to the exit temperature measurements. In this regard prior to extrusion, an upper and lower temperature limit for the exit temperature of the extruded product is selected. As explained in greater detail below, when the exit temperature is above the preselected maximum temperature or below minimum temperature, the heating and cooling units are activated and deactivated to keep the temperature within the desired range.

It has been observed that quite often the extrusion press is of ample capacity to force the metal through the die at much greater speeds than actually employed, but the operating speed is necessarily limited to that which will produce an acceptable sound surface on the product. Lowering the billet preheat temperature of subsequent billets permits the use of greater tonnage of the extrusion press without exceeding the maximum temperature limit that has been found to be critical for extruding the alloy involved. Surprisingly, by maintaining the temperature of the extruded product as it exits the die within a preselected temperature range, commercially acceptable extruded product can be produced without regard to heat generated by the working process itself, the speed of extrusion, the individual extruded shape, and the extrusion ratio.

Therefore, as shown in the feedback loop of FIG. 1, after the billet has been extruded, two determinations are made. The first is whether or not there is at least one additional billet to be extruded. If not, the process ends and the extrusion press is prepared for a new die and/or alloy.

Figure 2:
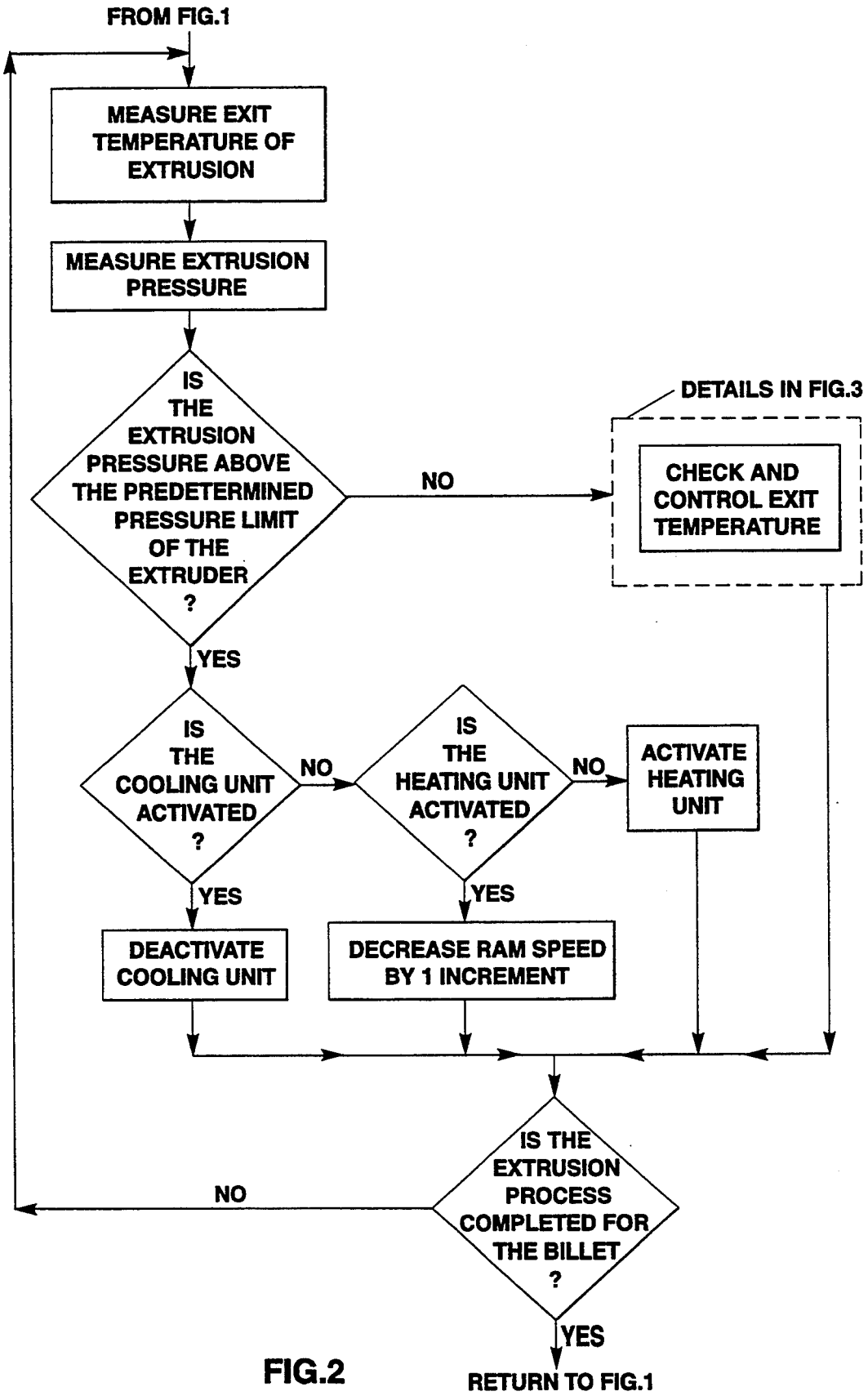
FIG. 2 is a logic and process flow diagram showing the details of the decisions and routes involved in a single process step illustrated in FIG. 1. Decisions in a feedback loop change the extrusion rate and control the heating unit and the cooling unit if the extrusion pressure exceeds a predetermined upper limit.
Figure 3:
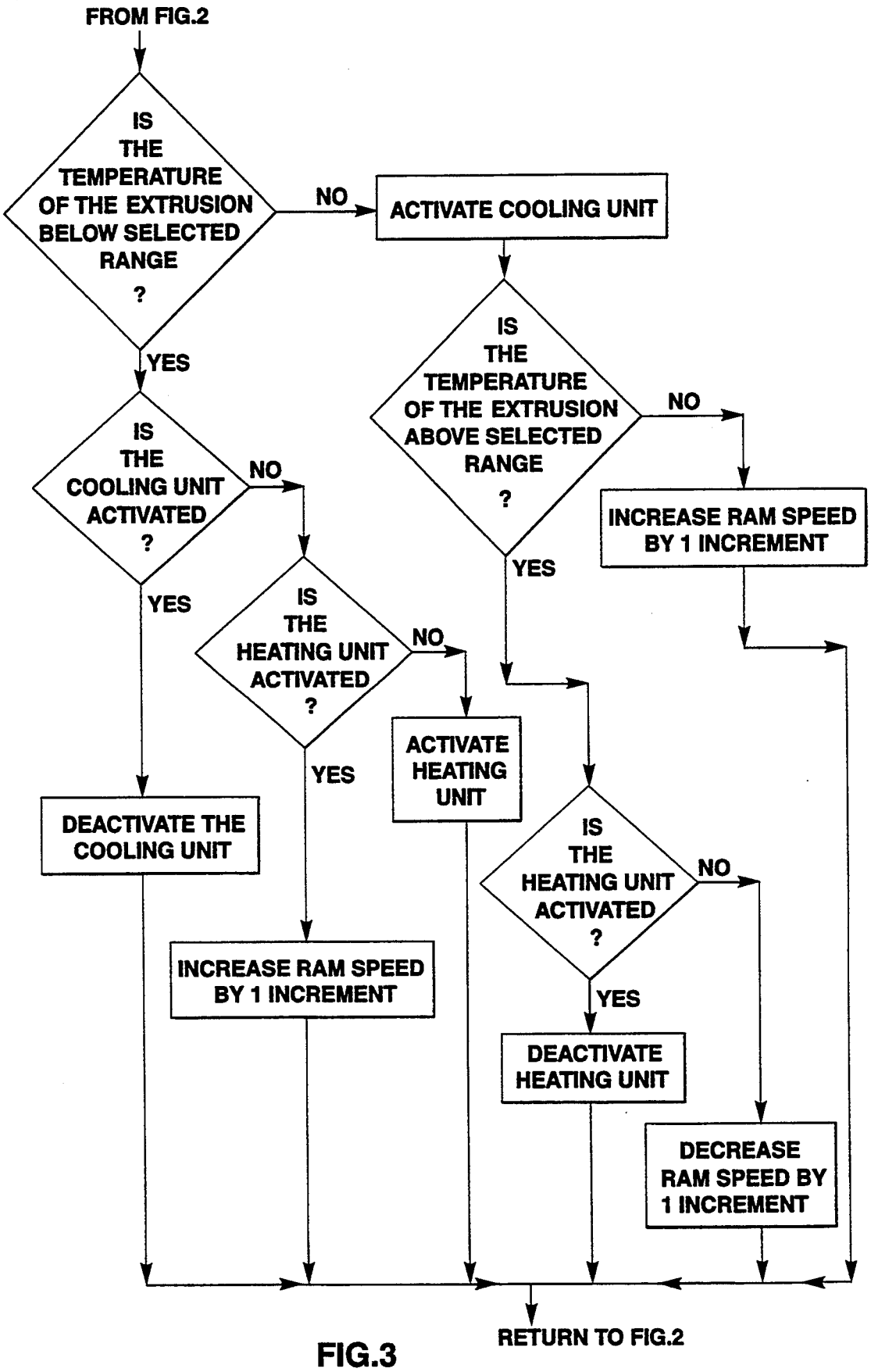
FIG. 3 is a logic and process flow diagram showing the details of the decisions and routes involved in a single process step illustrated in FIG. 2. Decisions change the extrusion rate and control the heating unit and the cooling unit based on the measured exit temperature of the extrusion.

If there is at least one additional billet, then a determination is made as to whether or not the billet preheat temperature can be reduced for the next billet. During the extrusion process, the tonnage of the extrusion press that is being used is monitored and controlled. The details of the monitoring and controls are shown in FIGS. 2 and 3 and discussed below. If the maximum capacity (or a selected maximum limit) of the extrusion press has been reached in extruding the billet, then the preheat temperature is not lowered. However, if the full capacity of the extrusion press is not being utilized, the furnace, which is used to preheat the billet, is reset downward by a predetermined increment to a new lower preheat temperature for the remaining billets in the run.

The preheat temperature may be reset manually by an operator who has been monitoring the output of the exit temperature sensing device. Alternatively, the temperature of the preheat furnace may be reset by a command signal sent from a microprocessor to the, furnace based on input from the temperature sensing device.

The predetermined increment or amount that the billet preheat temperature is lowered is not critical to the present invention. Typical increments will be on the order of 10° F. to 100° F., preferably 25° F. to 75° F. with an increment of about 50° F. being most preferable.

The larger the increment, the lower will be the resulting billet preheat temperature. A billet having a lower billet preheat temperature possesses more resistance to flow, and more capacity of the extrusion press must be utilized in the deformation process. More aggressively deforming the billet results in more internally generated heat; however, this heat can be absorbed by the lower temperature billet and extrusion press without the exit temperature of the extruded product exceeding the predetermined upper temperature limit.

In a commercial operation, billets are extruded one after another with a minimum downtime between billets. Therefore, the next billet in the run may already be heated to the previous preheat temperature. The productivity of the extrusion press is increased by using the extrusion press and not waiting for the next billet to cool to the new preheat temperature. Consequently, resetting the billet preheat temperature may not have an effect on the next billet in the series of billets to be extruded. Therefore, if the second billet is not allowed to cool to the second preheat temperature prior to extrusion, the process and flow decisions of FIG. 1 may signal an additional lowering of the billet preheat temperature. Care must be taken to avoid unwarranted decreases in the billet preheat temperature. If the billets are not permitted to cool to the reset preheat temperature, the actual preheat temperature of the billet should be used in making a determination that the billet preheat temperature needs to be reduced by another increment.

Surprisingly, the control attained in the process of FIGS. 2 and 3 allows one to decrease the preheat temperature and thereby increase the ram speed without decreasing the quality of the product that is being extruded. Information gained in monitoring and controlling the extrusion process is used to improve on empirically determined best billet preheat temperature for the extrusion.

The feedback loop of FIG. 1 has resulted in the increase of the output of an extrusion press by more than 30% without loss in commercial quality of the product. There is an optimum relationship between the preheat temperature of the billet, the speed of the extrusion press and the exit temperature of the resulting product. In the past, alloy composition and the shape, thickness and complexity of the extrusion have made it impractical to accurately predict the lowest preheat temperature that could be used for an extrusion. The process of FIG. 1 results in billets being extruded in a manner that more closely approaches the optimum conditions required for maximizing productivity without loss of extruded product due to poor quality.

Turning next to FIG. 2, there is illustrated a logic and process flow diagram showing the details of the decisions and routes involved in a single process step illustrated in FIG. 1 identified as controlling the process parameters. Four decisions in a feedback loop in FIG. 2 change the extrusion rate and control the heating unit and the cooling unit if the tonnage exceeds a predetermined upper limit. The decision sequence is not the sole manner for controlling the process parameter; however, it is believed to be the best mode for controlling the process.

The first step in FIG. 2 is to measure the exit temperature of the extruded product as it leaves the die and the extrusion pressure of the extrusion press. The two measurements may be performed in the sequence shown, simultaneously, or in an order reverse of that shown in FIG. 2.

Next, a determination is made as to whether the press is operating within a safe limit. If the measured extrusion pressure is above the predetermined maximum pressure for the extrusion press, the process follows the "yes" route. This route is directed to improving the flowability of the metal and thereby reduce the pressure that the extrusion press requires to extrude the metal.

If the pressure required to extrude is greater than the predetermined safe maximum pressure for operating the extrusion press, the decision sequence shown in FIG. 2 is to first check to make sure that any cooling unit, which the extrusion press may have to cool the die area, is deactivated. Cooling units are optional and are not needed for practicing the present invention. However, if one or more cooling units are used, deactivating them will reduce the pressure that the extrusion press requires to extrude the metal.

Once the cooling unit is deactivated, the process checks to determine if the billet has finished being extruded. If it has finished, the process returns to FIG. 1. If it is not, the feedback loop returns the process to FIG. 2 to take new extrusion pressure and exit temperature measurements. The process may return immediately to take new measurements, as is shown in FIG. 2, or the process may wait a predetermined length of time before returning; to take new measurements. If the process is being controlled by a microprocessor, it may be desirable to program it to wait at least 30 seconds before returning to take new measurements. Waiting a short time allows the die area to react to the deactivation of the cooling unit.

After new measurements are taken, or if the cooling unit is already deactivated, the process is to check to activate any heating unit available for heating the area in the vicinity of the die. Activating a heating unit will cause the metal to soften and thereby make it easier to deform.

Once the heating unit is activated, the process once again checks to determine if the billet has finished being extruded. If it has finished, the process returns to FIG. 1. If it has not, the feedback loop returns the process in FIG. 2 as before to take new extrusion pressure and exit temperature measurements. As before, waiting a short time allows the die area to react to the process change.

After new measurements are taken, or if the cooling unit is deactivated and the heating unit is activated, then the process is to decrease the ram speed. Decreasing the ram speed increases the time the metal is in the heated area of the die. The more heat the metal receives, the more deformable it becomes and the more likely it is that the pressure needed to extrude the metal will decrease.

Once again, the process is to check to determine if the billet has finished being extruded. If it has finished, the process returns to FIG. 1. If it has not, the feedback loop returns the process in FIG. 2 as before to take new extrusion pressure and exit temperature measurements. As before, waiting a short time allows the die area to react to the process change.

For the purposes of the flow diagram, the size of the increment with which the ram speed is decreased is not critical and may be varied depending on the extrusion ratio and die layout. Decreasing the ram speed is part of the feedback loop, and if the extrusion pressure is not lowered to a pressure that is below the desired maximum limit, the decision process of FIG. 2 will eventually lead us back and decrease the ram speed by another increment until were are below the temperature limit. From an ideal viewpoint, the temperature and pressure measurement would be continuously measured by a microprocessor, and the system would be continuously looping through the process.

Once the pressure in the extrusion press is below the predetermined upper limit of the press, the first decision in FIG. 2 will be the "no" route, and the process will continue in FIG. 3, controlling the temperature of the extrusion to insure that the extruded metal is of commercially acceptable quality.

The first decision in FIG. 3 is to determine if the exit temperature of the extruded metal is below the predetermined lower limit. If the temperature is below the lower limit selected in FIG. 1, then the process continues along the "yes" route from the first decision to the second decision which checks to determine if the cooling unit is activated. As stated above, cooling units are optional and need not be used in the practice of the present invention. However, cooling units will increase the speed at which metal can be extruded and are therefore recommended. Any known cooling unit can be used in practicing the present invention, including water cooling and or liquid nitrogen. From a coolant cost standpoint, water is the preferred coolant.

If the exit temperature of the extrusion is measured as being below the desired minimum temperature, the process is to determine if the cooling unit is activated. If the cooling unit is activated, it is deactivated. Once the cooling unit is deactivated, the process returns to FIG. 2 and checks to determine if the billet is finished being extruded. If it has finished, the process returns to FIG. 1. If it has not, the feedback loop returns the process to the top of FIG. 2 to take new extrusion pressure and exit temperature measurements as described above.

If the extrusion pressure is below the upper limit, the exit temperature of the extrusion is measured as being below the desired minimum temperature and the cooling unit is deactivated. The process is to determine if the heating unit is activated. The heating unit is activated if it is not, and the process loops back to FIG. 2 as before. If the heating unit is already activated, the extrusion rate is increased. Increasing the extrusion rate will increase the internally generated heat and thereby increase the exit temperature of the metal. The process then loops back to FIG. 2 to take new extrusion press and new exit temperature measurements.

Returning to the top of FIG. 3, if the exit temperature is measured as being above the lower temperature limit of the desired range, the process then continues along the "no" route from the first decision and the cooling unit is activated. The process is then to determine if the extrusion temperature is above the preselected upper temperature limit. If the temperature is below the preselected upper limit, the process is operating within the desired limits, and it continues along the "no" route. The ram speed is then increased by one increment before returning to FIG. 2 as before.

If the exit temperature is measured as being above both the lower and upper temperature limits, the process continues along the "yes" route in FIG. 3 to determine if the heating unit is activated. The process is then to either deactivate the heating unit or, if it is not activated, to decrease the ram speed and then return to FIG. 2 as described above. Both process steps have the effect of lowering the exit temperature of the metal and bringing the process into the desired operating ranges.

Ultimately, the billet is extruded and the next billet is preheated according to the decisions of FIG. 1 described above. Following extrusion, the extruded product is allowed to cool in air to room temperature. Subsequent processing may include solution heat treatment and quench. Upon emerging from the quench, the extruded product may be subjected to conventional processing such as stretch or roll straightening, natural or artificial aging, depending upon the final temper that is desired. Extrusions produced according to the present invention are at least of the same quality as conventionally processed extrusions.

Figure 4:
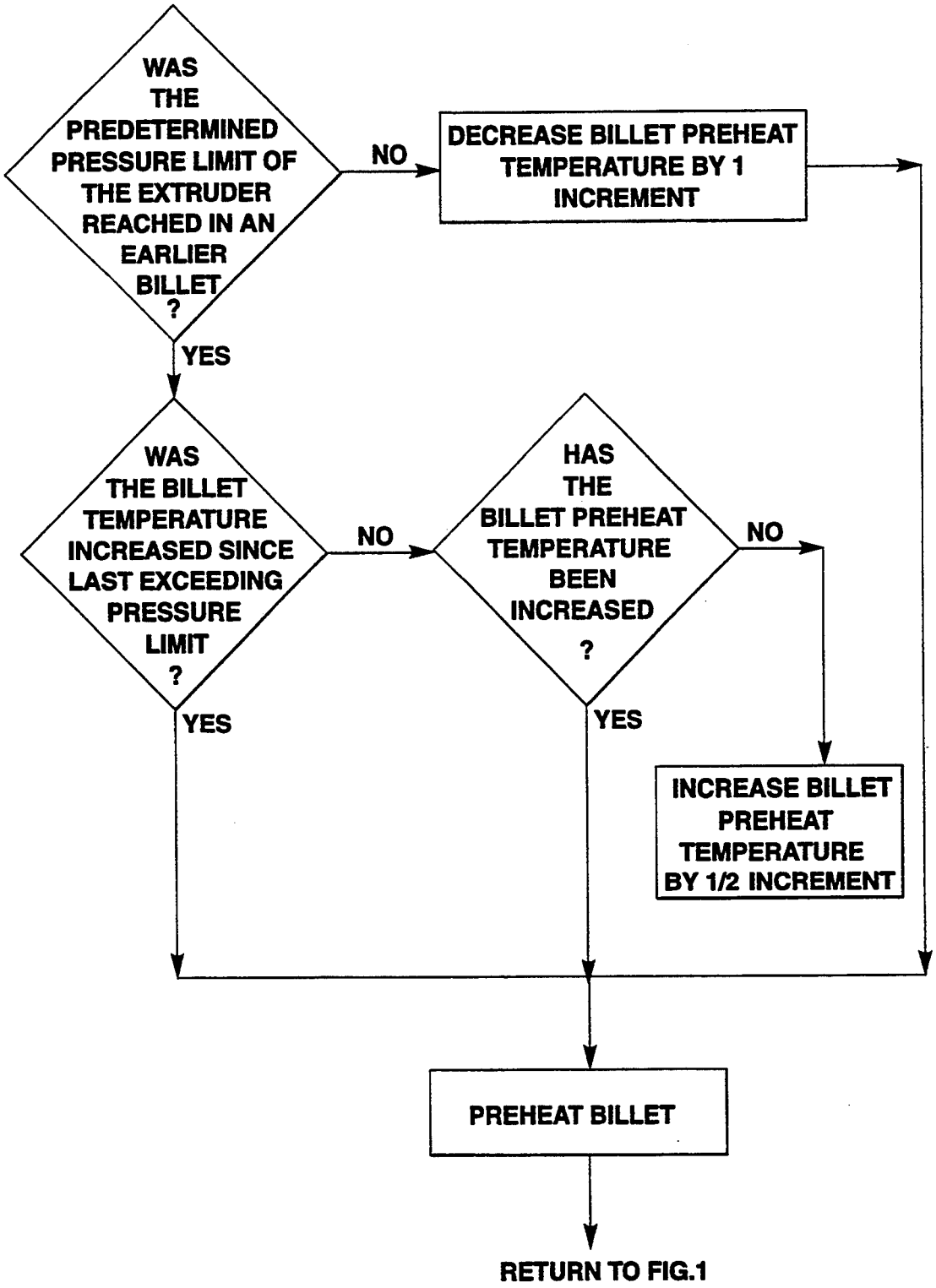
FIG. 4 is a logic and process flow diagram showing a variation of the decisions of the area of illustrated in FIG. 1 as Section IV. Decisions in a feedback loop raises or lowers the billet preheat temperature from a previous preheat temperature based on the extrusion pressure used in extruding the previous billets.

FIG. 4 is a logic and process flow diagram showing a variation of the decisions of the area illustrated in FIG. 1 as Section IV. Decisions in a feedback loop raise or lower the billet preheat temperature from a previous preheat temperature based on the tonnage used in extruding the previous billets.

If the billet preheat temperature is raised, it is raised to compensate for overshooting the lower limit of the billet preheat temperature. If the billet preheat temperature is increased it is increased only once and increased only ½ increment.

The following examples illustrate the preferred method of practicing the present invention and the advantage of the present invention over the prior art.

EXAMPLE 1

Aluminum Alloy 7178 is cast in a conventional manner. Billets having dimensions of 10 inches in length were made from the cast alloy. The billets were homogenized by heating the billets to about 870° F. (466° C.) and preheated to 600° F. (316° C.) prior to extrusion in a direct extrusion, 3000 ton extrusion press. The billets were extruded, and the process was monitored to insure that the exit temperature remained within a predetermined temperature range. The billet preheat temperature, the ram speed and calculated pounds extruded product per hour is recorded in the Table below. The maximum tonnage recorded in the extrusion process was 2600, and the peak ram speed was 2.1 inches per minute.

The resulting quality of the product was determined to be acceptable and is believed to be more uniform than product produced without the benefit of the method shown in FIGS. 2 and 3. Although the extruded product did not exhibit any defects, the full tonnage of the extrusion press was not utilized. The product was produced using the feedback arrangement shown in FIGS. 2 and 3 to insure that the temperature of the product as it exits the die is within a desired temperature range. This example demonstrates the condition of the prior art. Simply controlling the exit temperature produces good product but does not necessarily produce good product at the best levels of productivity. Since the data represents only a single billet, the feedback loop of FIG. 1 was not employed.

TABLE

| Example | Billet Length | Billet Temperature °F. | Pounds Per Hour | Percent Increase |
|---|---|---|---|---|
| 1 | 10 | 600 | 188 | 0 |
| 2 | 13 | 475 | 419 | 123 |
| 3 | 13 | 500 | 317 | 68 |
| 4 | 13 | 525 | 391 | 108 |

EXAMPLE 2

Another billet of Aluminum Alloy 7178 having a length of 13 inches was homogenized by heating the billet as in Example 1. However, the billet preheat temperature was reduced from that used in Example 1 based on the tonnage recorded during extrusion. The billet was decreased from Example 1, and the billet was preheated to 475° F. (245° C.) prior to extrusion in the same 3000 ton extrusion press. The change in billet preheat temperature from Example 1 was 125° F. The billet was extruded through the same die as in Example 1. The billet preheat temperature, the ram speed and calculated pounds extruded product per hour are recorded in the Table.

Surprisingly, the output of the extrusion press as measured in pounds of extruded product per hour was 123% greater than that of Example 1. Heretofore, one skilled in the art would have avoided using the preheat temperature of Example 2 for extruding AA7178 alloy through this particular die for fear of making a commercially unacceptable product.

EXAMPLE 3

Another billet of Aluminum Alloy 7178 was homogenized by heating the billet as in Example 1. However, the billet preheat temperature was reduced from that used in Example 1 based on the extrusion pressure recorded during extrusion. The billet was preheated to 475° F. (245° C.) prior to extrusion in the same 3000 ton extrusion press. The billet was extruded through the same die as in Example 1. The billet preheat temperature, the ram speed and calculated pounds extruded product per hour are recorded in the Table.

Surprisingly, the output of the extrusion press as measured in pounds of extruded product per hour was 68% greater than that of Example 1. Heretofore, one skilled in the art would have avoided using the preheat temperature of Example 2 for extruding AA7178 alloy through this particular die for fear of making a commercially unacceptable product.

EXAMPLE 3

Another billet of Aluminum Alloy 7178 was homogenized by heating the billet as in Example 1. However, the billet preheat temperature was reduced from that used in Example 1 based on the extrusion pressure recorded during extrusion. The billet was preheated to 500° F. (260° C.) prior to extrusion in the same 3000 ton extrusion press. The billet was extruded through the same die as in Example 1. The billet preheat temperature, the ram speed and calculated pounds extruded product per hour are recorded in the Table.

Surprisingly, the output of the extrusion press as measured in pounds of extruded product per hour was 108% greater than that of Example 1. Heretofore, one skilled in the art would have avoided using the preheat temperature of Example 2 for extruding AA7178 alloy through this particular die for fear of making a commercially unacceptable product.

It is to be appreciated that certain features of the present invention may be changed without departing from the present invention. Thus, for example, it is to be appreciated that although the invention has been described in terms of a preferred embodiment for extruding hard aluminum alloys, it will be apparent to those skilled in the art that the present invention will also be valuable in the fabrication of other metals. Metals suitable for use with the present invention are not limited to aluminum and aluminum alloys. Objects formed from other metals such as magnesium, copper, iron, zinc, nickel, cobalt, titanium, and alloys thereof may also benefit from the present invention.

Whereas the preferred embodiments of the present invention have been described above in terms of extruding hard aluminum alloys, it will be apparent to those skilled in the art that the method of forming the metal objects is not considered critical to its usefulness. It is contemplated also that the method and apparatus of the present invention will also be, valuable in increasing the productivity of other forming processes including rolling and stamping. In addition, whereas the invention has been described in terms of direct extrusion process, the invention can also be used in indirect extrusion.

Whereas the invention has been described in terms of increasing the productivity of extrusion presses, the invention can also be used in other continuous hot working operations known in the art, such as rolling sheet, plate and foil. In this embodiment of the invention, the temperature sensing device will be placed to measure the temperature of the metal as it exits the work rolls. A plurality of temperature measuring devices may be needed to measure the temperature at several points along the cross section of the sheet, plate or foil as it emerges from the work rolls.

It is further contemplated that the apparatus of the current invention can be constructed in a manner different than that shown in the figures. Thus for example, the sequence of decisions need not be the same as those shown in FIGS. 1–3. The key to the invention is that the process controls are used to lower the billet preheat temperature and thus increase the productivity of the extrusion press.

Whereas the preferred embodiments of the present invention have been described above in terms of being especially valuable in producing AA7178 aluminum alloy extrusions, it will be apparent to those skilled in the art that the present invention will also be valuable in producing extrusions made of other aluminum alloys containing about 80% or more by weight of aluminum and one or more alloying elements. Among such suitable alloying elements is at least one element selected from the group of essentially character forming alloying elements and consisting of manganese, zinc, beryllium, lithium, copper, silicon and magnesium. These alloying elements are termed as essentially character forming for the reason that the contemplated alloys containing one or more of them essentially derive their characteristic properties from such elements. Usually, the amounts of each of the elements which impart such characteristics are, as to each of magnesium and copper, about 0.5 to about 10 wt. % of the total alloy if the element is present as an alloying element in the alloy; as to the element zinc, about 0.05 to about 12.0% of the total alloy if such element is present as an alloying element; as to the element beryllium, about 0.001 to about 5.0% of the total alloy if such element is present as an alloying element; as to the element lithium, about 0.2 to about 3.0% of the total alloy if such element is present as an alloying element; and as to the element manganese, if it is present as an alloying element, usually about 0.15 to about 2.0% of the total alloy.

The elements iron and silicon, while perhaps not entirely or always accurately classifiable as essentially character forming alloy elements, are often present in aluminum alloy in appreciable quantities and can have a marked effect upon the derived characteristic properties of certain alloys containing the same. Iron, for example, which if often present and considered as an undesired impurity, is oftentimes desirably present and adjusted in amounts of about 0.3 to 2.0 wt. % of the total alloy to perform specific functions. Silicon may also be so considered, and while found in a range varying from about 0.25 to as much as 15%, is more often desirably found in the range of about 0.3 to 1.5% to perform specific functions. In light of the foregoing dual nature of these elements and for convenience of definition, the elements iron and silicon may, at least when desirably present in character affecting amounts in certain alloys, be properly also considered as character forming alloying ingredients.

Such aluminum and aluminum alloys, which may contain one or more of these essential character forming elements, may contain, either with or without the aforementioned character forming elements, quantifies of certain well known ancillary alloying elements for the purpose of enhancing particular properties. Such ancillary elements are usually chromium, nickel, zirconium, vanadium, titanium, boron, lead, cadmium, bismuth, and occasionally silicon and iron. Also, while lithium is listed above an essential character forming element, it may in some instances occur in an alloy as an ancillary element in an amount within the range outlined above.

When one of these ancillary elements is present in the aluminum alloy of the type herein contemplated, the amount, in terms of percent by weight of the total alloy, varies with the element in question but is usually about 0.05 to 0.4%, titanium about 0.01 to 0.25%, vanadium or zirconium about 0.05 to 0.25%, boron about 0.0002 to 0.04%, cadmium about 0.05 to 0.5%, and bismuth or lead about 0.4 to 0.7%.

What is believed to be the best mode of the invention has been described above. However, it will be apparent to those skilled in the art that these and other changes of the type described could be made to the present invention without departing from the spirit of the invention. The scope of the present invention is indicated by the broad general meaning of the terms in which the claims are expressed.

What is claimed is:

1. A method for extruding a plurality of billets, said method comprising:

(a) preheating a first billet to a preheat temperature;

(b) extruding said first billet to form a first extrusion having an exit temperature within a predetermined temperature range, said exit temperature is maintained within said predetermined temperature range by activating and deactivating a heating device to change the temperature of said billet that is being extruded if said exit temperature is above said predetermined temperature range;

(c) measuring extrusion pressure during (b);

(d) comparing said measured extrusion pressure of (c) to a reference pressure range;

(e) when said extrusion pressure is below said reference pressure range, resetting said first preheat temperature so that it is lowered by a predetermined increment to a second preheat temperature;

(f) when said extrusion pressure is above said reference pressure range, resetting said first preheat temperature so that it is raised by a predetermined increment to a second preheat temperature;

(g) preheating a second billet to said second preheat temperature; and (h) repeating (b)–(g) until said second billet has been extruded.

2. The method of claim 1 in which (b) includes activating and deactivating a cooling device.

3. The method of claim 1 in which (b) includes activating a cooling device if said exit temperature is above said predetermined temperature range.

4. The method of claim 1 in which (b) includes deactivating a cooling device if said exit temperature is below said predetermined temperature range.

5. The method of claim 1 in which (b) includes activating a heating device if said exit temperature is below said predetermined temperature range.

6. The method of claim 1 in which (b) includes deactivating a heating device if said exit temperature is above said predetermined temperature range.

7. The method of claim 1 in which the predetermined increment of (e) and (f) are of different absolute magnitudes.

8. The method of claim 1 in which the predetermined increment of (f) is equal to one half the predetermined increment of (e).

9. The method of claim 1 in which said billet is a metal billet.

10. The method of claim 1 in which said billet is a metal billet formed from a metal selected from the group of titanium, steel, aluminum, magnesium, copper, silver and alloys thereof.

11. The method of claim 1 in which said billet is a metal billet formed from an aluminum alloy.

12. The method of claim 1 in which said billet is a metal billet formed from a hard aluminum alloy.

13. The method of claim 1 in which said billet is a plastic billet.

14. A method of extruding comprising:

(a) providing an extrusion die with an integral heating unit;

(b) activating said heating unit to heat an extrusion die;

(c) heating a billet formed from a hard aluminum alloy to a metal preheat temperature;

(d) extruding said heated billet through said extrusion die;

(e) measuring the temperature of said extrusion as it exits said die; and (f) controlling the extrusion parameters so that the said exit temperature is within a predetermined temperature range.

15. The method of claim 14 which further includes:

(g) measuring the extrusion pressure during (d);

(h) comparing said measured extrusion pressure to a reference pressure range;

(i) if said extrusion pressure was below said reference pressure range, resetting said preheat temperature so that it is lowered by a predetermined increment;

(j) if said extrusion pressure climbed above said reference pressure range, resetting said preheat temperature so that it is raised by a predetermined increment;

(k) preheating another billet to said preheat temperature; and (l) repeating (b)–(k) until all the billets have been extruded.

16. The method of claim 14 in which said metal preheat temperature is between about 450° and 650° F.

17. The method of claim 14 in which said metal preheat temperature is between about 550° and 625° F.

18. The method of claim 14 in which said billet is formed from a hard aluminum alloy.

19. A method of extruding comprising:

(a) heating metal billet to a preheat temperature;

(b) extruding said metal billet through a die;

(c) detecting the exit temperature of freshly extruded metal as it exits said die;

(d) comparing said exit temperature to a reference temperature range; and (e) varying the extrusion parameters so that said exit temperature is within said reference temperature range, said varying of the extrusion parameters includes activating and deactivating a heating device to change the temperature of said metal billet that is being extruded if said exit temperature is above said reference temperature range.

20. The method of claim 19 wherein said step of varying said extrusion parameters includes activating a cooling device if said exit temperature is above said reference temperature range.

21. The method of claim 19 wherein said step of varying said extrusion parameters includes deactivating a cooling device if said exit temperature is below said reference temperature range.

22. The method of claim 19 wherein said step of varying said extrusion parameters includes activating a heating device if said exit temperature is below said reference temperature range.

23. The method of claim 19 wherein said step of varying said extrusion parameters includes deactivating a heating device if said exit temperature is above said reference temperature range.

24. The method of claim 19 wherein said step of varying said extrusion parameters includes activating and deactivating a cooling device.

25. A method for extruding metal, said method comprising:

(a) generating a signal which is related to the exit temperature of metal as it is being extruded through a die;

(b) comparing said signal to a reference temperature range; and (c) varying the extrusion parameters so that said exit temperature is within said reference temperature range, said varying of the extrusion parameters includes activating and deactivating a heating device to change the temperature of said metal billet that is being extruded if said exit temperature is above said reference temperature range.

26. The method of claim 25 in which said step of varying the extrusion parameters so that said exit temperature is within said reference range includes, when the generated signal is above said reference range:

(a) deactivating the heating unit if it is activated, (b) activating a cooling unit if the heating unit is deactivated; and (c) decreasing the extrusion ram speed by 1 increment if the heating unit is deactivated and the cooling unit is activated.

27. The method of claim 26 wherein said increment is between 10° F. to 100° F.

28. The method of claim 26 wherein said increment is between 25° F. to 75° F.

* * * * *